US007431097B2

(12) United States Patent
Weightmann

(10) Patent No.: US 7,431,097 B2
(45) Date of Patent: Oct. 7, 2008

(54) APPARATUS AND METHOD FOR INJECTING TUBING INTO A WELL

(75) Inventor: Glenn H. Weightmann, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 346 days.

(21) Appl. No.: 10/985,160

(22) Filed: Nov. 10, 2004

(65) Prior Publication Data

US 2006/0096754 A1 May 11, 2006

(51) Int. Cl.
*E21B 19/22* (2006.01)
*E21B 41/00* (2006.01)

(52) U.S. Cl. ..... 166/384; 166/250.01; 166/77.3; 73/862.194

(58) Field of Classification Search ..... 166/250.01, 166/384, 77.3; 73/862.194
See application file for complete search history.

(56) References Cited

U.S. PATENT DOCUMENTS 2,938,319 A * 5/1960 Nystrand ..... 53/214
4,509,323 A * 4/1985 Ledvina et al. ..... 59/8
4,567,437 A * 1/1986 Hubbard ..... 324/237
5,234,053 A * 8/1993 Connell ..... 166/250.01
5,426,968 A * 6/1995 Mertens ..... 73/862.474
5,632,372 A * 5/1997 Steinbuchel et al. ..... 198/813
5,850,874 A * 12/1998 Burge et al. ..... 166/77.3
5,895,332 A * 4/1999 Olson et al. ..... 474/113
5,975,203 A * 11/1999 Payne et al. ..... 166/77.3
6,173,769 B1 1/2001 Goode ..... 166/77.3
6,209,634 B1 * 4/2001 Avakov et al. ..... 166/77.3
6,216,780 B1 4/2001 Goode et al. ..... 166/77.3
6,276,454 B1 * 8/2001 Fontana et al. ..... 166/343
6,367,557 B1 4/2002 Rosine et al. ..... 166/384
6,883,711 B2 * 4/2005 Patton ..... 235/462.14
2003/0034397 A1 * 2/2003 Patton ..... 235/462.14
2003/0209346 A1 11/2003 Austbo et al. ..... 166/77.2
2004/0142792 A1 * 7/2004 Glas et al. ..... 477/70

FOREIGN PATENT DOCUMENTS

WO WO 3093783 A1 * 11/2003

OTHER PUBLICATIONS

U.S. Appl. No. 10/840,787 entitled "Hydraulic Circuit And Method For Operating A Gripping Device" by Robert E. Domann, filed May 6, 2004.
U.S. Appl. No. 10/840,786 entitled "Apparatus and Method For Injecting Tubing in a Well Bore" by Robert E. Domann, et al., filed May 6, 2004.

* cited by examiner

*Primary Examiner*—Shane Bomar
(74) *Attorney, Agent, or Firm*—John W. Wustenberg; Conley Rose, P.C.

(57) ABSTRACT

The disclosed invention is an apparatus for injecting tubing into a well while sensing wear within the apparatus, along with a method for sensing wear, according to which the tubing is engaged by a chain and the linear motion of the tubing and the chain is sensed.

18 Claims, 4 Drawing Sheets

APPARATUS AND METHOD FOR INJECTING TUBING INTO A WELL

BACKGROUND

The present invention relates to an apparatus and method for injecting tubing into a well utilizing a drive chain, and, more particularly, to such an apparatus and method for monitoring stretching of the chain. The phrase "chain stretch" or "stretch" is commonly used in the industry to indicate the net lengthening of the chain due to wear of the members (rollers, pins, etc.) comprising the chain. Stretching does not mean that the metal members of the chain have elongated due to elastic or plastic deformation.

Coiled tubing injectors are often used to inject coiled tubing into an oil or gas well to facilitate the servicing of the well. These injectors usually include a pair of chains that extend to either side of the coiled tubing, and gripper blocks mounted to the chains for engaging the coiled tubing and driving it into the well. Also, depth indicators are often used that engage the chain and provide an indication of the depth of the coiled tubing based on the movement of the chain.

However, the chains can stretch with use and age, leading to ultimate failure of the chain, and, in the meantime, causing erroneous readings from the depth indicators.

Therefore, what is needed is a system and method for monitoring chain stretch so that the above problems can be avoided.

DETAILED DESCRIPTION

Figure 1:
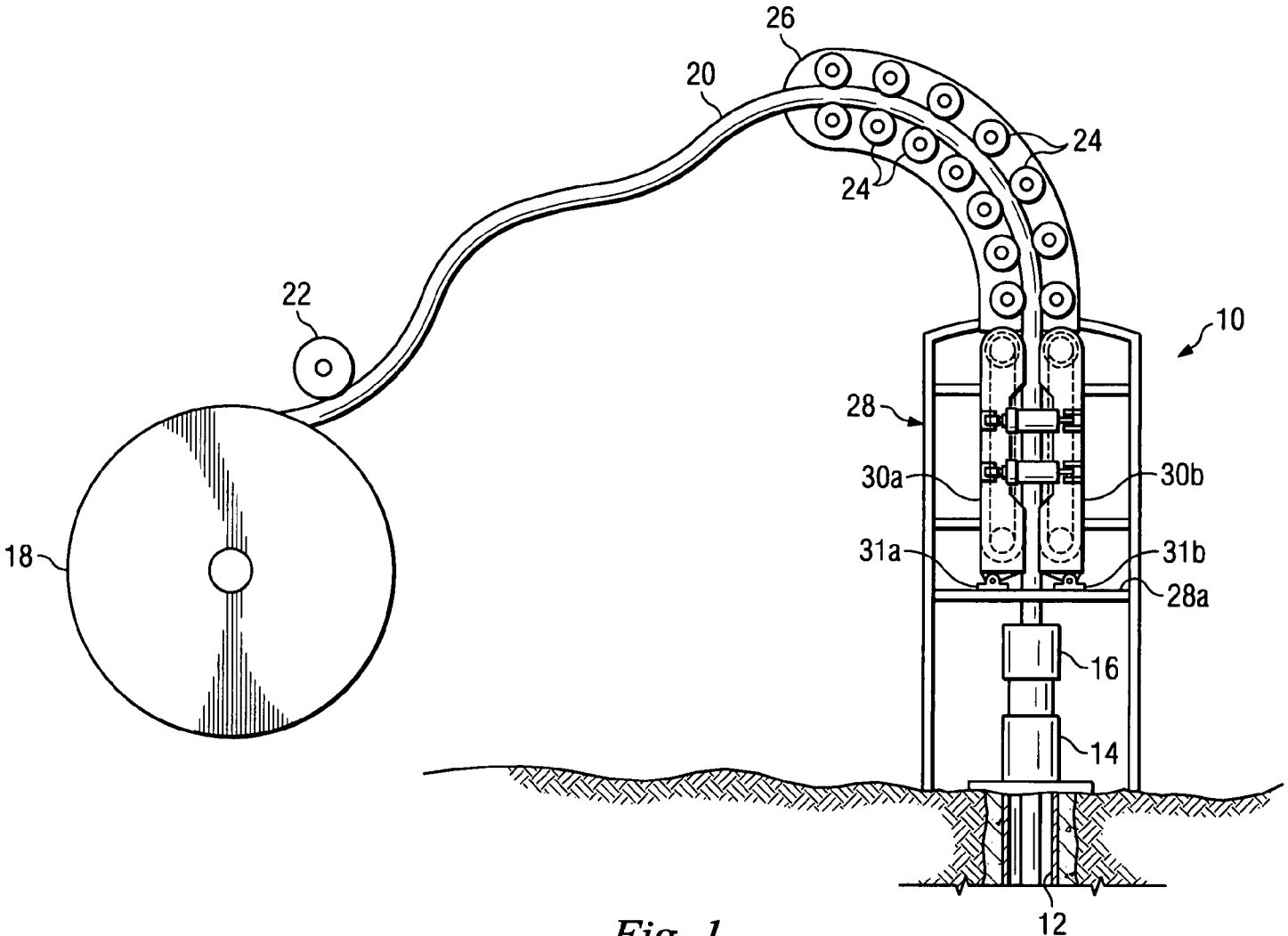
FIG. 1 is a partial elevational/partial sectional view, not necessarily to scale, depicting a coiled tubing injector according to an embodiment of the invention.

Referring to FIG. 1, the reference numeral 10 refers, in general, to a coiled tubing injector 10 positioned directly above a well 12. A wellhead 14 extends above the well 12, and a depth, or linear motion, sensing device 16 extends above the wellhead 14 and will be described in detail. It is understood that a lubricator, or stuffing box (not shown) can be associated with the wellhead 14.

A spool 18 of coiled tubing 20 is positioned at a predetermined location away from the injector 10. The unspooled tubing 20 passes from the spool 18 and under a measuring device, such as a wheel 22, and between several (seven in the example of FIG. 1) pairs of opposed rollers 24 rotatably mounted to an arcuate support platform 26. The tubing 20 then passes from the last pair of rollers 24 into the injector 10.

The injector 10 is constructed and arranged in a manner to be described to drive the tubing 20 into the well 12, and the depth sensing device 16 includes a wheel (not shown) that engages an outer surface of the tubing 20, and an encoder to provide an output signal corresponding to the linear motion of the tubing 20 as it passes into the well 12. Since the depth sensing device 16 is conventional, it will not be described in further detail.

The injector 10 includes a frame 28 having a base 28*a*, and a pair of substantially similar carriages 30*a* and 30*b* mounted on the base 28*a* via a pair of carrier lugs 31*a* and 31*b*. The carriages 30*a* and 30*b* drive the tubing 20 through the wellhead 14 and into the well 12.

Figure 2:
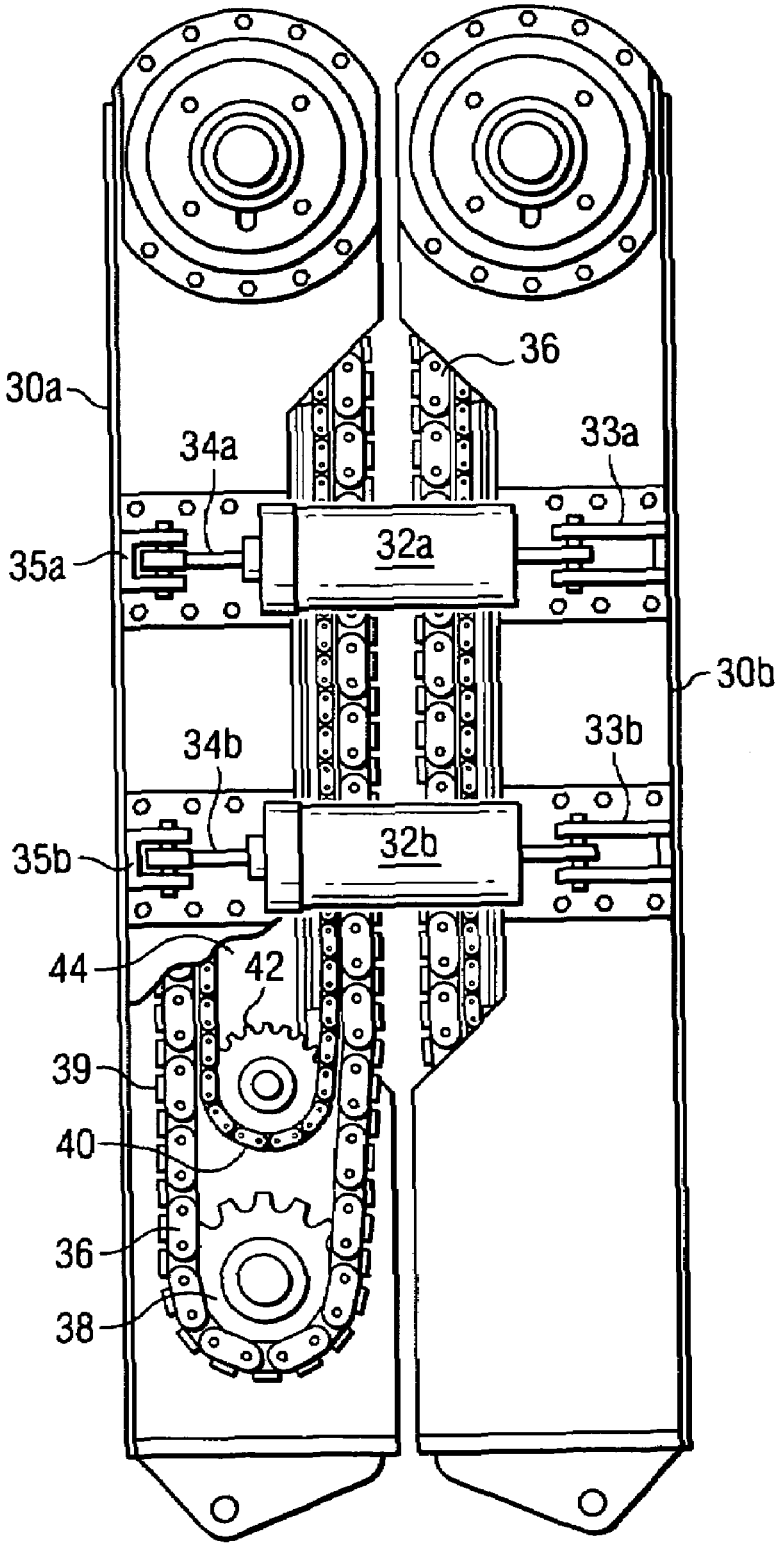
FIG. 2 is an enlarged view of a portion of the injector of FIG. 1.

The carriages 30*a* and 30*b* are depicted in greater detail in FIG. 2, with the remaining structure of the injector 10 and the tubing 20 being removed from the drawing in the interest of clarity. Two hydraulically-actuated cylinders 32*a* and 32*b* extend between the carriages 30*a* and 30*b* and are connected to the carriage 30*b* by two mounting brackets 33*a* and 33*b*, respectively. Two rods 34*a* and 34*b* extend out from the cylinders 32*a* and 32*b*, respectively, with one end of each rod being connected to its corresponding piston and the other end connected to the carriage 30*a* by two mounting brackets 35*a* and 35*b*, respectively. Each cylinder 32*a* and 32*b* includes a piston (not shown) that reciprocates in a cylindrical housing in response to hydraulic fluid being introduced into, and discharged from, the housing, in a conventional manner. This reciprocation causes corresponding contraction and extension of the cylinders 32*a* and 32*b* to move the carriages 30*a* and 30*b* towards each other to grip the tubing 20, and away from each other to release the tubing 20. It is understood that two other cylinders (not shown), identical to the cylinders 32*a* and 32*b*, are connected to the carriages 30*a* and 30*b* on the other sides of the carriages 30*a* and 30*b*. The cylinders 32*a* and 32*b* are described in greater detail in assignee's co-pending patent application Ser. No. 10/840,786, filed May 6, 2004, the disclosure of which is incorporated herein by reference in its entirety.

The carriage 30*a* includes a gripping chain 36 extending between, and engaged with, two spaced sprockets 38 (one of which is shown in FIG. 2) for driving the gripping chain 36 in an endless path. A plurality of gripping elements 39 are mounted to the outer surface of the gripping chain 36 and are adapted to engage and grip the tubing 20 in a conventional manner.

A roller chain 40 is also provided that extends within the gripping chain 36 and engages two spaced sprockets 42 (one of which is shown in FIG. 2). Both the roller chain 40 and the gripping chain 36 are disposed around a linear beam 44, shown partially in FIG. 2, and the gripping elements 39 of the gripping chain 36 engage the tubing 20 along substantially the entire length of the linear beam 44. Details of the linear beam 44 and its associated components are also disclosed in the above application.

It is understood that a motor (not shown) is provided to drive at least one of the sprockets 38, and therefore the gripping chain 36. The outer surface of the roller chain 40 is in engagement with the inner surface of the gripping chain 36 and is free wheeling about its sprockets 42 and the engagement between the chains 36 and 40 is such that the gripping chain 36 drives the roller chain 40 which functions to support the gripping chain 36.

Figure 3:
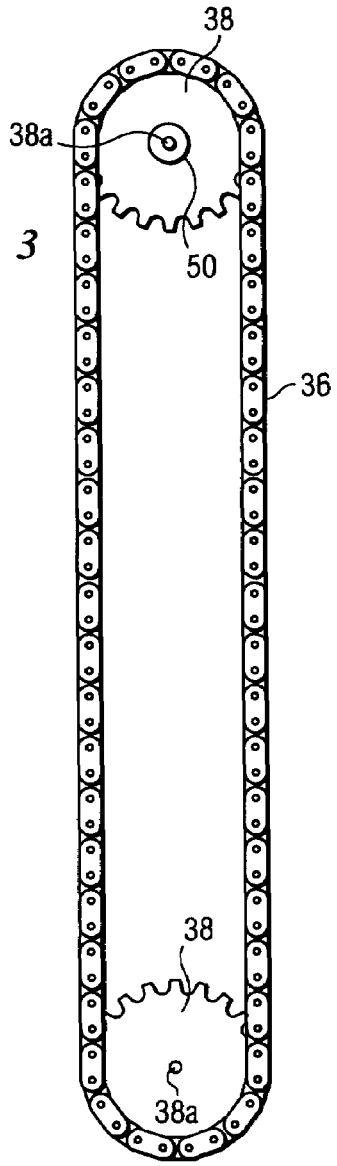
FIG. 3 is an enlarged front elevational view depicting a portion of one of the chains of FIG. 2.

FIG. 3 depicts the gripping chain 36 and the sprockets 38 of the carriage 30*a*, with the remaining associated components discussed above being omitted in the interest of clarity. The sprockets 38 rotate with, or about, two shafts 38*a*, respectively, and one of the sprockets 38 (or its shaft 38*a*) is driven by a motor, or the like (not shown) and therefore functions as a drive sprocket. This, in turn, drives the gripping chain 36 in an endless path, as well as the other sprocket 38 which functions as an idler sprocket.

A rotation sensing device 50, preferably in the form of a rotation wheel/encoder, is mounted on one of the sprockets 38 (the upper one as viewed in FIG. 3), which can either be the drive sprocket or the idler sprocket, and is adapted to generate an output signal corresponding to the rotation of the sprocket 38, in terms of revolutions per unit time. Since the rotation sensing device 50 can be in the form of one of several conventional rotation sensing devices, it will not be described in detail.

The carriage 30*b* (FIG. 2) is identical to the carriage 30*a* and is positioned with the inner portion of its gripping chain 36 facing the inner portion of the gripping chain 36 of the carriage 30*a*. A rotation sensing device, identical to the rotation sensing device 50, can be provided on one of the sprockets 38 (not shown) for the gripping chain 36 associated with the carriage 30*b*, and functions in the same manner as described above in connection with the rotation sensing device 50.

Figure 4:
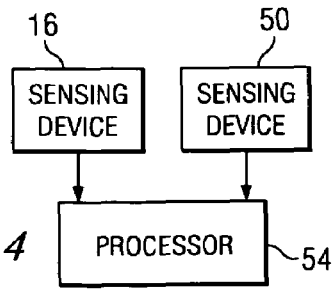
FIG. 4 is diagrammatic view including a processor used with the above embodiment.

As shown in FIG. 4, the depth sensing device 16 and the rotation sensing device 50 are electrically connected to a processor 54 which receives the outputs generated by the sensing devices 16 and 50. The processor 54 includes software and a data processor, and is programmed to enable it to process the signals from the sensing devices 16 and 50 and to provide an output, or visual indication, based on the signals, as will be described.

In operation, and referring to FIGS. 1 and 2, the tubing 20 is unspooled from the spool 18 and passes through the rollers 24 where it is straightened before it enters the injector 10. The cylinders 32*a* and 32*b* are normally in their extended positions and are actuated to force them to their retracted position and therefore drive the carriages 30*a* and 30*b* towards each other until the gripping elements 39 on the gripping chains 36 engage the tubing 20 at a predetermined loading. The above-mentioned motors are then activated to drive the drive sprocket 38 and the gripping chain 36 of each carriage 30*a* and 30*b*, to drive the tubing 20 into the well 12.

The depth sensing device 16 and the rotation sensing devices 50 associated with the carriages 30*a* and 30*b* function to produce output signals corresponding to the depth, or linear motion, of the tubing 20, as it passes into the well 12, and the rotation of one of the sockets 38 associated with the carriages 30*a* and 30*b*, respectively. As shown in FIG. 4, the output signals from the sensing devices 16 and 50 are passed to the processor 54, which processes the signals in the following manner.

When the gripping chain 36 of each carriage 30*a* and 30*b* is unstretched, the outputs of the corresponding sensing devices 16 and 50 are calibrated to produce a predetermined output. Thus, a given amount of linear motion (length) of the tubing 20 passing by the depth sensing device 16 will cause a specific amount of rotation of the sprockets 38 associated with the carriages 30*a* and 30*b*. As a non-limitative example, the system could be calibrated so that a predetermined amount of linear motion, or length, of the tubing 20 will produce a specific rotation of the sprockets 38 associated with the carriages 30*a* and 30*b*. The linear motion and the revolutions are sensed by the sensing devices 16 and 50, respectively, and corresponding output signals are sent from the sensing devices 16 and 50 to the processor 54.

Assuming that the gripping chain 36 associated with the carriage 30*a* stretches over time and with use, this ratio will change, since the same sensed linear motion of the tubing 20 will cause less revolutions of the sprocket 38 associated with the carriage 30*a* as sensed by the corresponding rotation sensing device 50. The processor 54 is programmed to respond to this change and provide a corresponding output signal or visual indication, to alert an operator that the gripping chain 36 has stretched and the degree of stretching. Of course, any stretching of the gripping chain 36 of the carriage 30*b* will result in a similar output from the processor 54. Thus, the stretched chain(s) 36 can be replaced to prevent the problems discussed above.

Figure 5:
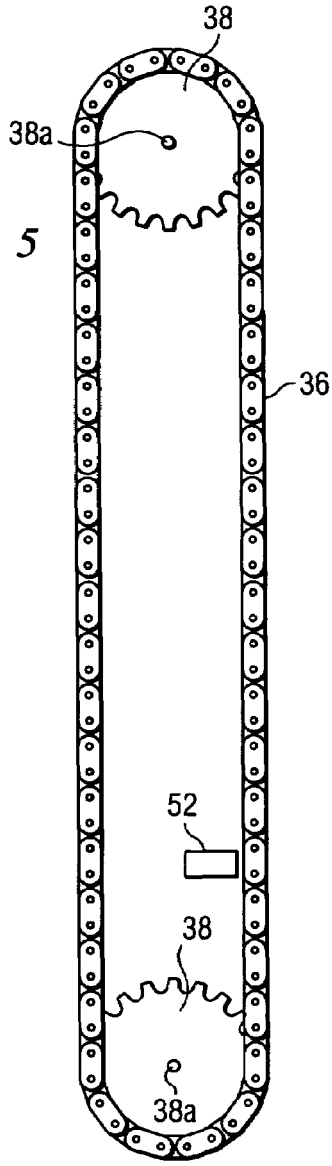
FIGS. 5 and 6 are views similar to FIGS. 3 and 4, respectively, and depicting an alternate embodiment.
Figure 6:
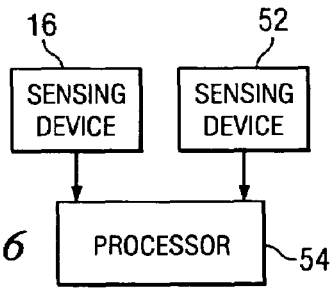

The embodiment of FIGS. 5 and 6 is similar to the embodiment of FIGS. 1-4, and utilizes several components of the latter embodiment, which are given the same reference numerals. FIG. 5 depicts the gripping chain 36 and the sprockets 38 of the carriage 30*a*, with the remaining associated components discussed above being omitted in the interest of clarity. According to the embodiment of FIG. 5, the rotation sensing device 50 of the previous embodiment is eliminated and a proximity sensing device 52 is mounted on the carriage 30*a* in close proximity to the gripping chain 36. The proximity sensing device 52 is adapted to continuously detect movement of the components making up the gripping chain 36, which for example would be the individual chain links. The proximity sensing device 52 provides an output that represents the frequency at which the gripping chain 36 components pass by the proximity sensing device 52 as the gripping chain 36 drives the tubing 20 (FIGS. 1 and 2) into the well 12. The embodiment of FIGS. 5 and 6 also includes the depth sensing device 16 of the previous embodiment which functions in the same manner as described above.

In operation, the tubing 20 is driven into the well 12 in the same manner as described above, while the depth sensing device 16 senses the linear motion of the tubing 20 as it is injected into the well 12. The proximity sensing device 52 senses the frequency of passage of the components, or links, of the gripping chain 36, and provides corresponding output signals to the processor 54.

Thus, the system could be calibrated so that, when the gripping chain 36 is unstretched, a predetermined amount of linear motion, or length, of the tubing 20, as sensed by the depth sensing device 16, will result in a corresponding frequency of passage of the components, or links, of the gripping chain 36, as sensed by the proximity sensing device 52. Corresponding output signals are sent from the sensing devices 16 and 52 to the processor 54.

When the gripping chain 36 stretches over time and with use, fewer components of the gripping chain 36 pass by and are sensed by the proximity sensing device 52 during the same amount of sensed linear motion of the tubing 20, due to the fact that the components are farther apart due to the stretching. The processor 54 receives corresponding output signals from the sensing devices 16 and 52 and is programmed to respond to this change and provide a corresponding output signal, or visual indication, to alert an operator that the gripping chain 36 has stretched and the degree of stretching. Of course, any stretching of the gripping chain 36 of the carriage 30*b* will result in a similar output from the processor 54. Thus, the stretched gripping chain(s) 36 can be replaced to prevent the problems discussed above.

Although this embodiment was described in connection with the gripping chain 36 on the carriage 30*a*, it is understood that a sensing device identical to the proximity sensing device 52 can also be mounted on the carriage 30*b* of the injector 10 (FIGS. 2 and 3) and connected to the processor 54. Thus, any stretching of the gripping chain 36 associated with carriage 30*b* will result in a similar output from the processor 54.

Figure 5A:
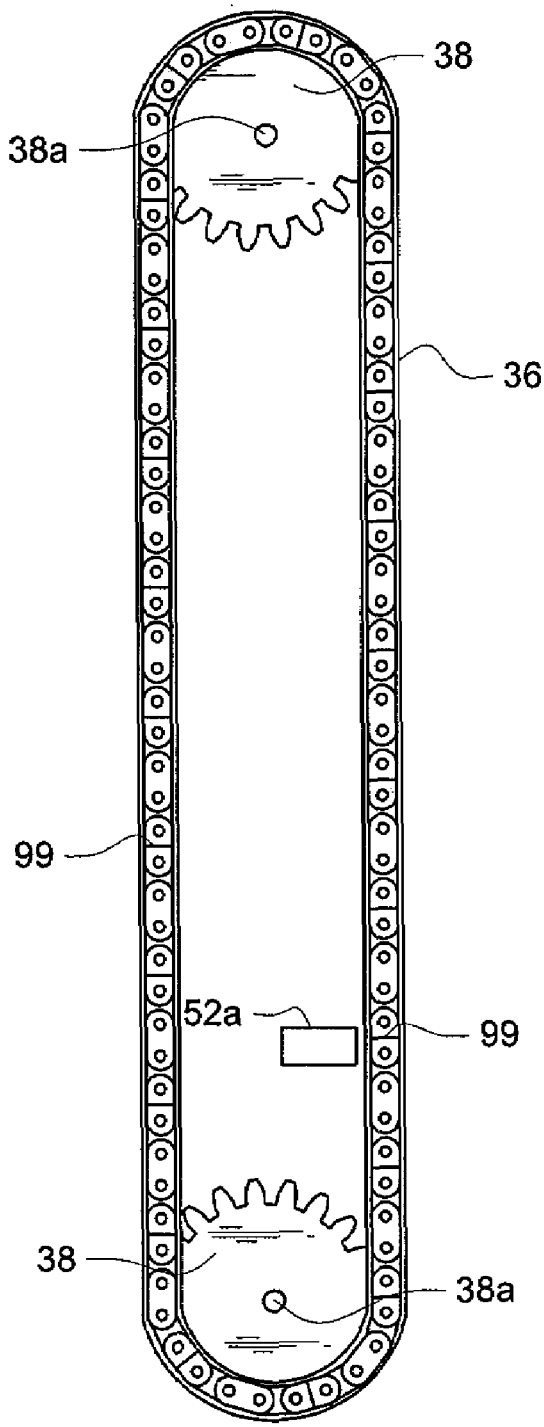
FIG. 5A is an enlarged front elevation view depicting a portion of the chain in an embodiment having a laser scanner and indicia on links of the chain.

According to another embodiment, the proximity sensing device 52 could be designed to sense linear motion of the gripping chain 36 as it passes by the proximity sensing device 52, and send a corresponding output signal. This could be done in any conventional manner such as providing the proximity sensing device 52 with a laser scanner 52*a* that is pointed at the gripping chain 36 and providing indicia 99, or the like, on the gripping chain 36 that is scanned by the laser scanner 52*a,* as illustrated in shown in FIG. 5A. Thus, the system could be calibrated so that, when the gripping chain 36 is unstretched, a predetermined amount of linear motion, or length, of the tubing 20, as sensed by the depth sensing device 16 will result in a corresponding amount of linear motion of the gripping chain 36, as sensed by the proximity sensing device 52; and corresponding output signals would be sent from the sensing devices 16 and 52 to the processor 54.

When the gripping chain 36 streches over time and with use, the amount of linear motion of the gripping chain 36 sensed by the proximity sensing device 52 decreases during the same amount of sensed linear motion of the tubing 20, due to the fact that the sensed indicia are father apart due to the stretching. The processor 54 recevies corresponding output signals from the sensing devices 16 and 52 and is programmed to respond to this change and provide a corresponding output signal or visual indication, to alert an opeator that the gripping chain 36 has stretched and the degree of stretching.

Although this embodiment was described in connection with the gripping chain 36 on the carriage 30*a*, it is understood that a sensing device identical to the proximity sensing device 52 can also be mounted on the carriage 30*b* of the injector 10 (FIGS. 2 and 3) and connection to the processor 54. Thus, any stretching of the gripping chain 36 associated with carriage 30*b* will result in a similar output from the processor 54.

It is understood that variations may be made in the foregoing embodiments without departing from the scope of the invention. For example, the rotation sensing device 50 of the embodiment of FIGS. 1-4 can be associated with either the drive sprocket 38 or the idler sprocket 38 (e.g., the sprocket that is not driven), or with a third sprocket (not shown) that engages the gripping chain 36 for the sole purpose of driving the rotation sensing device 50. Also, the sensing devices 50 and 52 can be associated with one or both of the gripping chains 36 and/or with one or both of the roller chains 40. Also, in all of the embodiments, the depth sensing device 16, or a similar device for measuring the length of the tubing 20 that is inserted in the well 12 can be associated with the injector 10 rather than in the location shown in FIG. 1. Further, the above techniques can be utilized in the above manner when the tubing 20 is withdrawn from the well 12 and spooled back on the spool 18, with the direction of movement being opposite that discussed above. Also, the gripping elements 39 can be eliminated and the gripping chains 36 can directly engage the tubing 20. Still further, any of the foregoing spatial references, such as "upper," "between," "front," "side," "above," etc., are for the purpose of illustration only and do not limit the specific spatial orientation of the structure described above.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for injecting tubing into a well, comprising:

a chain adapted to engage the tubing and drive the tubing into the well;

a first sensing device for sensing motion of the tubing;

a second sensing device for sensing motion of the chain; and a processor;

wherein:

the sensing devices produce signals corresponding to the motions sensed;

the processor processes the signals from the sensing devices to monitor for stretching of the chain; and the processor monitors for stretching by calibrating a ratio of motion of the tubing to motion of the chain and monitoring for changes to the ratio.

2. The apparatus of claim 1 wherein the first sensing device senses linear motion of the tubing as the tubing passes from the chain into the well.

3. The apparatus of claim 1 further comprising a roller chain having an outer surface; wherein the chain adapted to engage the tubing and drive the tubing into the well is a gripping chain having an outer surface adapted to engage the tubing and an inner surface, and the outer surface of the roller chain is in engagement with the inner surface of the gripping chain so as to support the gripping chain.

4. The apparatus of claim 1 wherein the processor produces an output signal or visual indication indicative of stretching of the chain.

5. The apparatus of claim 4 wherein the output signal or visual indication from the processor relates to rotation of the chain and linear motion of the tubing.

6. The apparatus of claim 4 wherein the output signal or visual indication from the processor relates to linear motion of the chain and linear motion of the tubing.

7. The apparatus of claim 1 wherein the chain comprises a plurality of interconnected links, and the second sensing device comprises a proximity sensing device adapted to sense links passing by the second sensing device.

8. The apparatus of claim 1 wherein the second sensing device comprises a scanner for scanning the chain.

9. The apparatus of claim 8 wherein indicia is on the chain, and the scanner scans the indicia.

10. A method for injecting tubing into a well, comprising the steps of:

engaging the tubing with a gripping chain for driving the tubing into the well;

sensing the motion of the tubing;

sensing the motion of the gripping chain;

producing signals corresponding to the motions sensed; and processing the signals to monitor for stretching of the gripping chain; wherein:

the step of processing the signals to monitor for stretching of the gripping chain comprises:

calibrating a ratio of motion of the tubing to motion of the gripping chain; and monitoring for change of the ratio.

11. The method of claim 10 further comprising the step of producing an output signal or visual signal indicative of stretching of the gripping chain.

12. The method of claim 11 wherein the output signal or visual indication is related to rotation of the gripping chain and linear motion of the tubing.

13. The method of claim 11 wherein the output signal or visual indication is related to linear motion of the gripping chain and linear motion of the tubing.

14. The method of claim 10 wherein the step of sensing the motion of the gripping chain comprises sensing links of the gripping chain passing by a proximity sensing device.

15. The method of claim 10 wherein the step of sensing the motion of the gripping chain comprises scanning the gripping chain with a scanner.

16. The method of claim 15 wherein the scanner scans indicia placed on the gripping chain.

17. The method of claim 10 further comprising the step of supporting the gripping chain with a roller chain engaged with the gripping chain and moving with the gripping chain.

18. The method of claim 10 wherein the motion of the tubing is sensed as the tubing passes from the gripper chain into the well.

* * * * *